US005542328A

United States Patent [19]

Pimentel

[11] Patent Number: 5,542,328

[45] Date of Patent: Aug. 6, 1996

[54] PIANO HAMMER RAIL STOP ASSEMBLY

[76] Inventor: Robert L. Pimentel, 5325 Elk Horn Blvd., Ste. 250, Sacramento, Calif. 95842

[21] Appl. No.: 399,737

[22] Filed: Mar. 7, 1995

[51] Int. Cl.[6] ..... G10C 3/00

[52] U.S. Cl. ..... 84/220; 84/216

[58] Field of Search ..... 84/170, 171, 172, 84/216, 220, 221

[56] References Cited

U.S. PATENT DOCUMENTS

| | | | |
|---|---|---|---|
| 210,043 | 11/1878 | Lomas | 84/670 |
| 533,661 | 2/1895 | McChesney et al. | 84/670 |
| 5,194,685 | 3/1993 | Kawamura et al. | 84/670 |
| 5,428,186 | 6/1995 | Kaneko et al. | 84/719 |
| 5,434,349 | 7/1995 | Kawamura | 84/719 |
| 5,444,181 | 8/1995 | Wada et al. | 84/719 |

FOREIGN PATENT DOCUMENTS

| | | |
|---|---|---|
| 3707591 | 5/1988 | Germany . |
| 3-98093 | 4/1991 | Japan . |

*Primary Examiner*—Patrick J. Stanzione
*Attorney, Agent, or Firm*—James M. Ritchey

[57] ABSTRACT

For use with a piano having key activated hammers, each hammer striking a selected string upon activation by the associated key, a rail stop assembly that comprises a rotational hammer stopping rail for preventing the hammers from striking the selected strings. Included is a mechanism for moving the hammer stopping rail between a first position for blocking the hammers and a second position for allowing the hammers to strike the selected strings.

19 Claims, 4 Drawing Sheets

PIANO HAMMER RAIL STOP ASSEMBLY

BACKGROUND OF THE INVENTION

1. Field of the Invention

Disclosed are means for permitting a user of a keyboard musical instrument, in particular a piano, to play in either a standard fashion or in a silent fashion in which the traditional hammer produced string sounds from the piano are blocked while still permitting the user to depress the keys on the piano's keyboard. A rail stop assembly is described which includes a rail stop that, when rotated into position over hammers within a piano, obstructs the hammers from hitting or contacting the piano strings, thereby effectively silencing the normal sound coming from the piano.

2. Description of the Background Art

Early attempts to halt the motion of a piano key hammer were attempted but with limited success. Simple devices were utilized in blocking the travel of each hammer. The subject invention has greatly improved on earlier stops by including easy activation between blocking and non-blocking modes or positions, easy installation due to the structural form of the subject invention, and the ability to block a large number of hammers with one subject rail stop.

Disclosed in U.S. Pat. No. 210,043 is a piano string damper that permits a user to soften the sound of a string that is hit by a hammer. A felt cushion swings out to partially impede the velocity of a hammer.

A hammer-arrest is related in U.S. Pat. No. 533,661. The hammer-arrest comprises a slide bar that is positioned to various location to dampen or partially dampen a hammer striking a piano string.

U.S. Pat. No. 5,194,685 discloses a hammer movement detection device that detects the performance state in a keyboard musical instrument.

German Patent No. 3,707,591 relates a piano hammer mechanism having a hinged hammer damping member.

Patent No. 3-98093 from Japan provides a piano mechanism that determines a striking force for each moving hammer.

The foregoing patents reflect the state of the of which the applicant is aware and are tendered with the view toward discharging applicant's acknowledged duty of candor in disclosing information which may be pertinent in the examination of this application. It is respectfully submitted, however, that none of these patents teach or render obvious, singly or when considered in combination, applicant's claimed invention.

SUMMARY OF THE INVENTION

An object of the present invention is to provide a simple yet effective mechanism for temporarily blocking the hammers of stringed musical instruments from striking the strings.

Another object of the present invention is to supply a rail stop assembly that is easily introduced into a piano.

A further object of the present invention is to disclose a rail stop assembly that is capable of selectively blocking or not blocking a plurality of hammers from striking corresponding strings within a keyboard musical instrument.

Still another object of the present invention is to detail a rail stop mechanism having a pivotal connection which permits a rail stop to be moved from active to passive locations between the hammers and strings of a piano.

Disclosed is a rail stop assembly for use with a piano having key activated hammers. Each hammer within the piano strikes a selected string upon activation by the associated key. The rail stop assembly comprises a rotational hammer stopping means for preventing a plurality of the hammers from striking the selected strings. The rotational hammer stopping means comprises a rail stop. Specifically, the rail stop comprises an elongated rail having a lower surface and a shock absorbing pad for cushioning the impact of the hammer affixed to the rail lower surface.

Additionally comprising the rail stop assembly is a brace bracket for securing the assembly to an interior wall of the piano. Pivot means are provided for connecting in a rotational joining the rail stop to the rail bracket. The pivot means comprises a pivot rod having first and second ends with the first end secured to the rail stop and the second end extending away from the rail stop, a rail bracket adjustably mounted to the brace bracket, and means for rotationally coupling the pivot rod second end to the rail bracket.

Further included in the rail stop assembly are activating means for moving the rotational hammer stopping means between a first position for blocking the hammers and a second position for allowing the hammers to strike the selected strings. The activating means comprises a lever means for applying a torsional force to the rotational hammer stopping means, thereby causing rotation of the rotational hammer stopping means, actuating means for directing operation of the lever means, and linkage means for coupling the actuating means to the lever means. Preferably, the actuating means is hand operated and usually a hand operated lever secured to an exterior surface of the piano. Generally, the linkage means comprises a cable secured to and between the lever means and the actuating means.

Other objects, advantages, and novel features of the present invention will become apparent from the detailed description that follows, when considered in conjunction with the associated drawings.

DESCRIPTION OF THE PREFERRED EMBODIMENT

Figure 1:
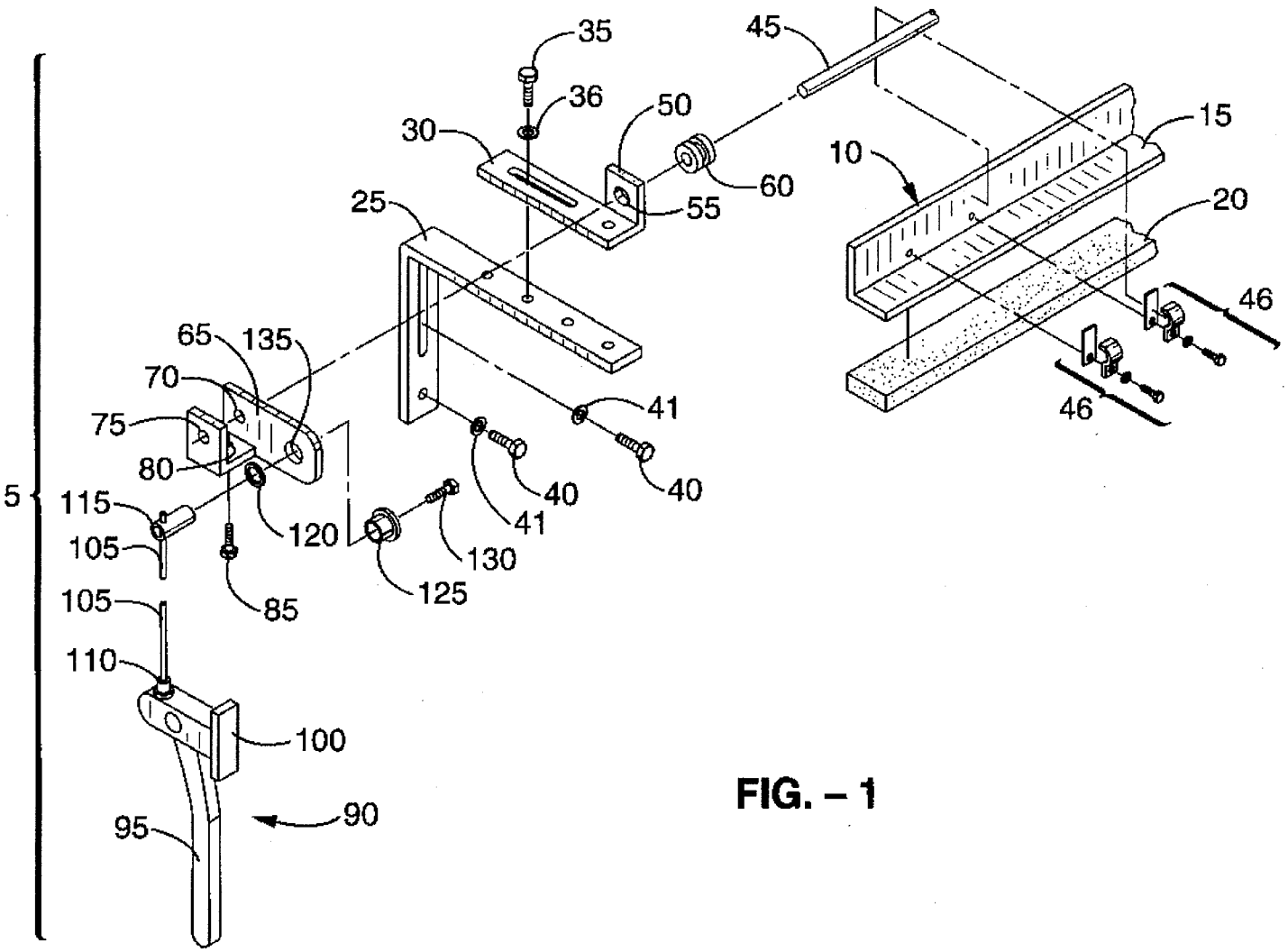
FIG. 1 is an exploded view of the subject invention.
Figure 2:
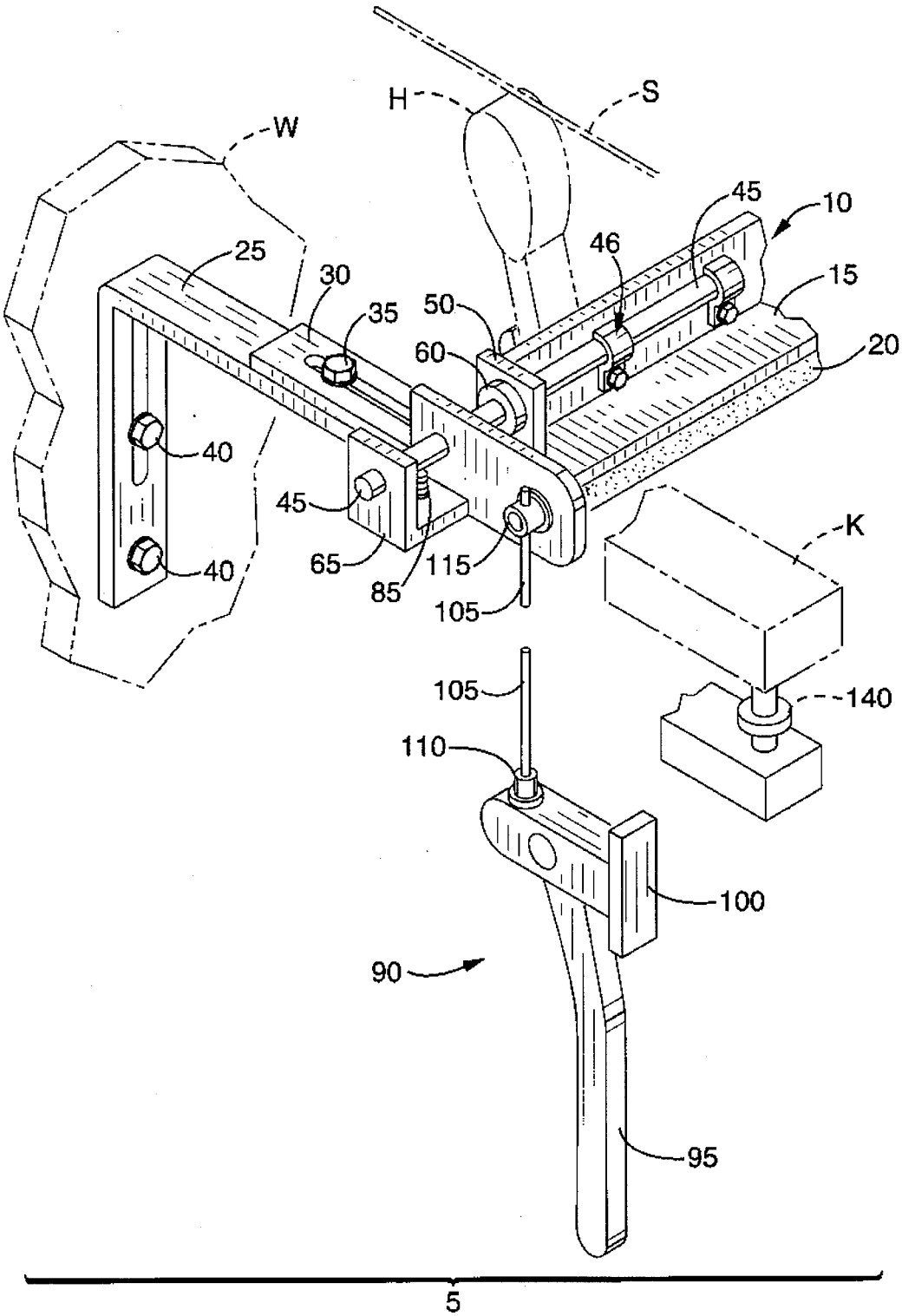
FIG. 2 is a perspective view of the subject invention.

Referring now to FIGS. 1–4, there is shown a preferred embodiment of a piano hammer rail stop assembly. It is often desirable to block temporarily the contact between a piano hammer and the string normally struck by that hammer. Thus, the subject invention serves as a means for temporarily stopping or blocking the motion of the hammers within the piano, or other keyboard instrument having hammers and strings, before those hammers hit designated strings within the keyboard instrument.

Often pianists find a need to practice without making noise. The subject invention permits a pianist to strike the keys in a normal manner yet produce no sound. Additionally, pianos may be constructed or modified in a fashion that introduces key-associated or activated sensors, and the equivalent, that trigger the generation of electronic signals when the keys are played. The produced signals are processed into sounds, recorded, or utilized in other suitable ways. In particular, when key produced signals are desired without accompanying normal piano string sounds, the subject invention can be activated to block the hammers from striking the piano strings.

The subject invention is attached within a keyboard musical instrument and secured to a suitable structural member of the instrument such as a wall W. Comprising the subject rail stop assembly 5 is a rotational hammer stopping means for preventing a plurality of the hammers H from striking the selected strings S. Preferably, the rotational hammer stopping means includes a rail stop that has an elongated rail 10 with a lower surface 15. The rail 10 is of suitable length to span between a plurality of hammers H and their corresponding strings S. Usually, the rail 10 is generally "L" shaped, however, other equivalent forms are acceptable.

Secured to the lower surface 15 of the rail 10 is a shock absorbing pad 20 for cushioning the impact of the hammers H as they strike the rail 10. The pad 20 is affixed to the rail lower surface 15 by appropriate means such as adhesive or other bonding, clamps, and the like. The pad 20 is fabricated from suitable materials such as synthetic or natural polymers, felt, or equivalent substrates that absorb the impact of the striking hammers. One suitable example of a material useful for fabricating the pad 20 is produced by E-A-R Specialty Composites, a division of Cabot Safety Corporation, 7911 Zionsville Road, Indianapolis, Ind. 46268 under the part number LS-1519, but other equivalent materials are within the realm of this disclosure.

For anchoring or securing the assembly to an interior wall of the piano a bracket is supplied. Ordinarily, the brace bracket is comprised of an angled brace bracket 25, a generally linear rail bracket 30, and means for adjusting the relationship of the brace bracket 25 and rail bracket 30 to one another. The adjusting means is usually a screw 35 and washer 36 or the equivalent. By means of the bracket adjusting means the rail 10 is moved closer or further from the wall 10. The brace bracket 25 is fastened to the wall W by means of screw 40 and washer 41 or the equivalent.

Included in the subject invention are pivot means for connecting in a rotational joining the rail stop to the rail or brace bracket. The pivot means comprises a pivot rod 45 having first and second ends. The first end of the pivot rod 45 is secured to the rail stop at the rail 10 by appropriate means 46 usually comprising a clip, screw, and gasket or like means. The second end of the pivot rod 45 extends away from the rail stop or rail 10.

Means for rotationally coupling the pivot rod 45 second end to the rail bracket 30 are provided. Preferably, the rail bracket 30 includes a flange 50 having an aperture 55 that receives a grommet 60 and the second end of the pivot rod 45. Preferably, the grommet 60 is configured and structured to be a shock absorber that absorbs vibrations generated from hammer contact. One suitable vibration absorbing grommet 60 fabricated from a polyurethane elastomer is sold by E-A-R Specialty Composites, a division of Cabot Safety Corporation, 7911 Zionsville Road, Indianapolis, Ind. 46268 under the part number G-410-1, but equivalent vibration absorbing grommets are acceptable.

The pivot rod 45 extends past the flange 50 and connects with activating means for moving the rotational hammer stopping means between a first position for blocking the hammers H and a second position for allowing the hammers H to strike the selected strings S. It is noted that for additional stability, a pivot rod 45 may be secured to both ends of the rail 10 and then fitted proximate each rail 10 end to a corresponding rail bracket 30, flange 50, aperture 55, and grommet 60. Further, a series of rails 10, connected via a single common pivot rod 45 or multiple pivot rods 45 that run from one rail 10 to the next rail 10 within the piano, can be activated by one or more associated pivot means.

Preferably, the activating means comprises a lever means for applying a torsional force to the rotational hammer stopping means, thereby causing rotation of the rotational hammer stopping means and in particularly the rail 10. Included in the lever means is a bracket lever 65 having suitable first 70 and second 75 apertures through which the pivot rod 45 is passed. The pivot rod 45 is releasably secured to the bracket lever 65 via an aperture 80 in the bracket lever 65 that receives a set screw or bolt 85 or the equivalent.

The lever means is actuated by means that exert a suitable level of force onto the bracket lever 65 to produce the desired rotation about the pivot rod 65. Actuating means such as a lever handle assembly 90, plunger assembly (not shown), or equivalent is appropriate for directing operation of the lever means, specifically the bracket lever 65. Comprising the lever handle assembly 90 is a handle 95 that extends from a handle base 100. The handle base 100 is adapted for affixing to a suitable location on the exterior of the keyboard instrument such as beneath the region where the keys mount or any other user accessible location. Once affixed, the lever handle assembly 90 is moved by the user (generally a hand movement is required) to rotate the rail stop between active and passive blocking positions.

Coupling the actuating means to the lever means are linkage means. Usually, the linkage means comprises a cable 105 secured to and between the lever means (specifically the bracket lever 65) and the actuating means (specifically the lever handle assembly 90). Although a cable 105 is depicted as the preferred linkage means, other equivalent means such as belts, chains, remote means (signal generators and receivers coupled with drive means) and the like are considered to be within the realm of this disclosure. Ordinarily, the two ended cable 105 is secured by a first end to the handle 95 via standard attachment means 110 and then extends to link at a second end with the bracket lever 65. Preferably, securing the cable 110 second end to the bracket lever 65 is a combination of an internally threaded retainer 115, washer 120, bushing 25, screw or bolt 130, and an aperture 135 in the bracket lever 65. Other equivalent means for securing the cable 105 to the bracket lever 65 are considered possible.

Figure 3:
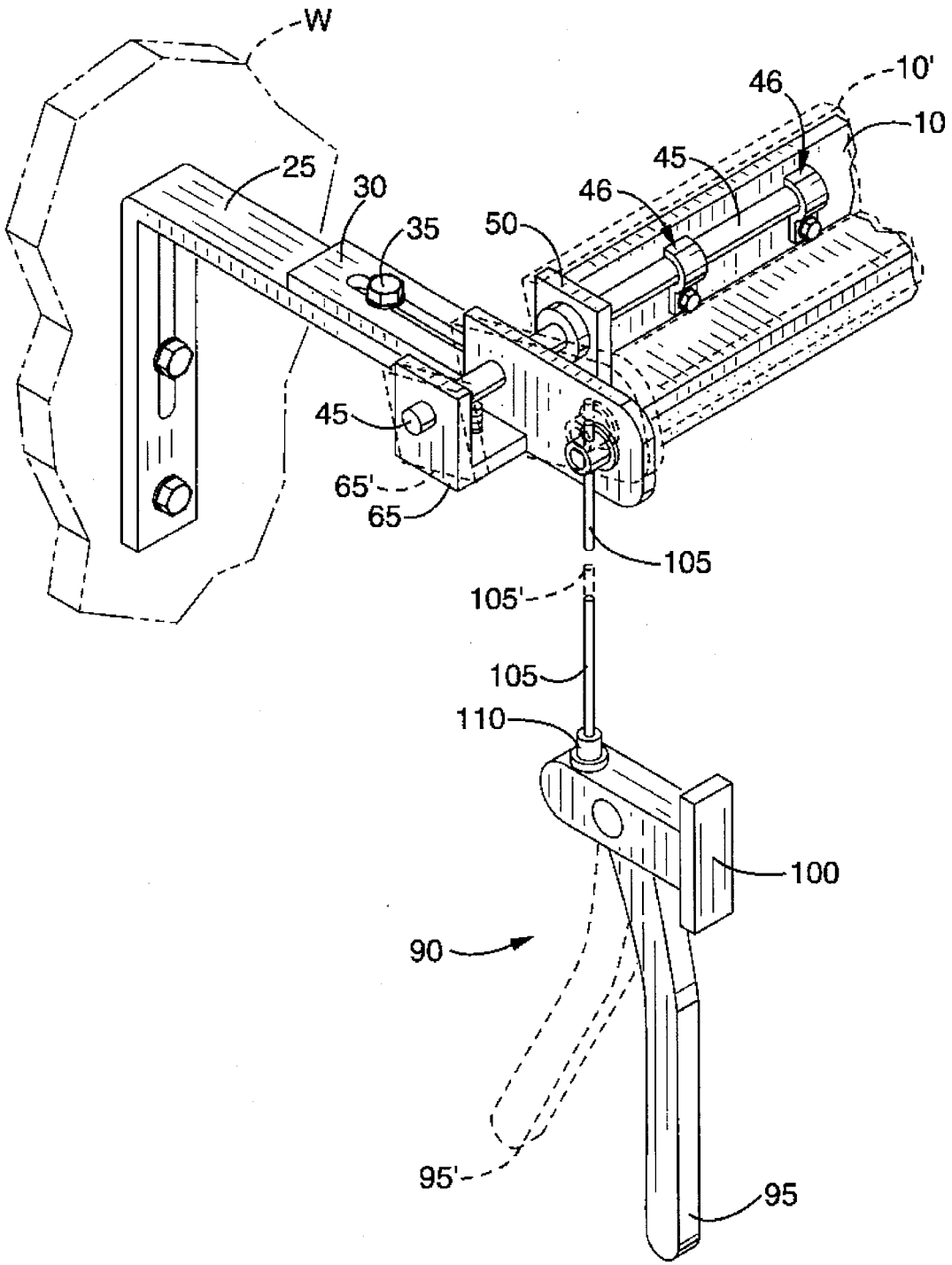
FIG. 3 is a perspective view of the subject invention showing the linkage of movement between the lever actuating means and the rail stop of the subject invention.
Figure 4:
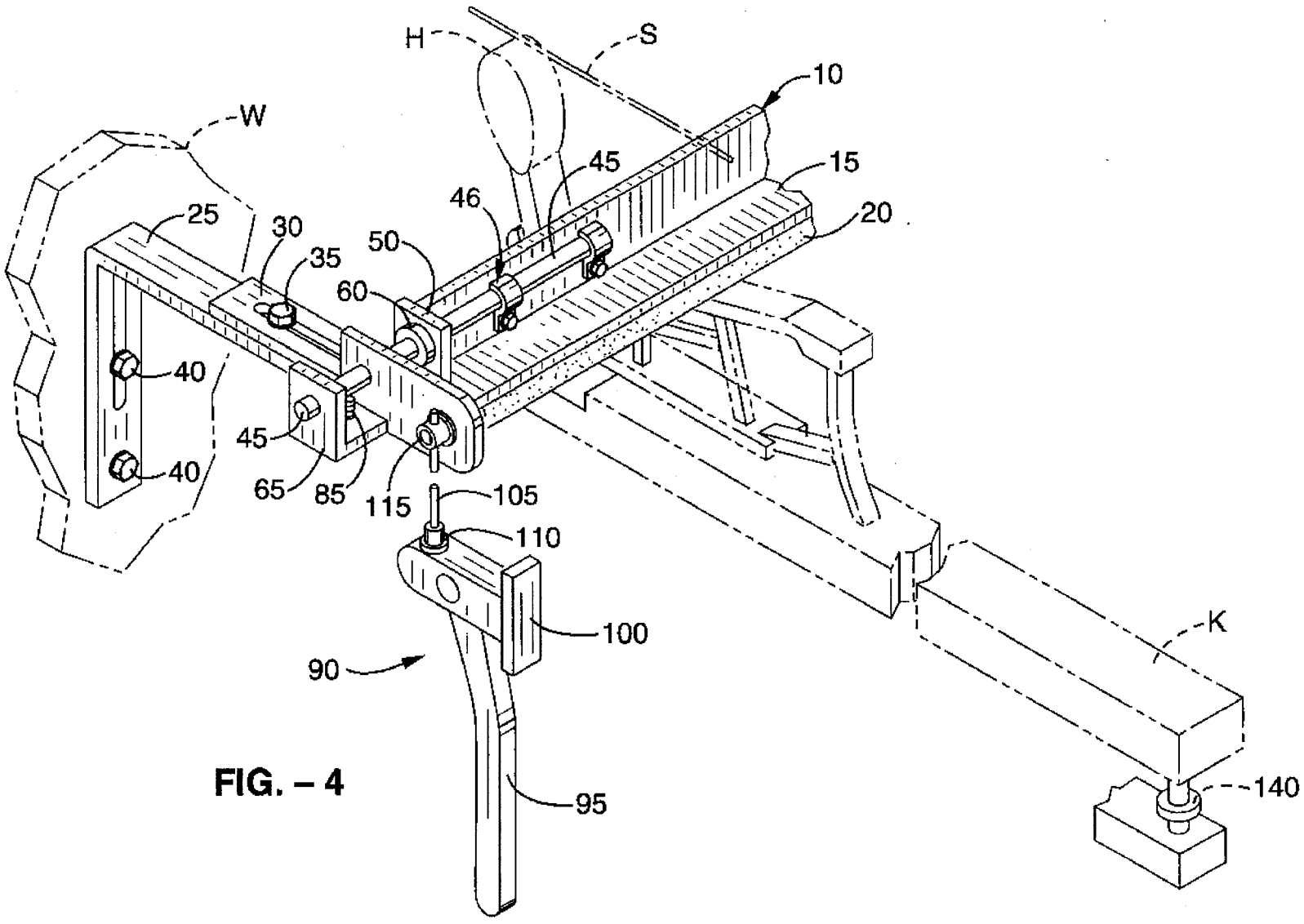
FIG. 4 is a perspective view showing the positioning of a piano hammer relative to the positioning of the subject invention inside a piano.

As seen in FIG. 3, the solid lines indicate the rail 10 and related components positioned in the hammer H blocking mode while the dashed lines indicate the subject components being rotated into a non-blocking mode. The primed numbers elements (10', 65', 95', and 105') indicate the non-blocking rotation movement. The actual final location of the rotated rail 10 and the associated elements is dictated by the exact position in which the subject assembly is located in the keyboard instrument and the dimensions between the hammers H and strings S.

Preferably, the subject invention is utilized in combination with a piano that is adapted with key K associated sensors 140 that send information about key movements via signals to linked processing equipment. The processing equipment uses the key generated signals for sound generation, recording purposes, and the like.

The subject invention is either directly incorporated into a newly constructed keyboard instrument or utilized in a retro-fit procedure to adapt a preexisting keyboard instrument. Depending upon the exact structural elements of the keyboard instrument, more than one subject rail stop assembly may be incorporated into an instrument. Many keyboard instruments require two, three, or more of the subject devices to optionally block all of the hammers H.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. For use with a piano having key activated hammers, each hammer striking a selected string upon activation by the associated key, a rail stop assembly, comprising:

a) rotational hammer stopping means for preventing a plurality of the hammers from striking the selected strings, wherein said rotational hammer stopping means comprises:
a rail stop;
a brace bracket for securing the assembly to an interior wall of the piano; and
pivot means for connecting in a rotational joining said rail stop to said rail bracket and b) activating means for moving said hammer stopping means between a first position for blocking the hammers and a second position for allowing the hammers to strike the selected strings.

2. A rail stop assembly according to claim 1, wherein said rail stop comprises:

a) an elongated rail having a lower surface and b) a shock absorbing pad for cushioning the impact of the hammer affixed to said rail lower surface.

3. A rail stop assembly according to claim 1, wherein said pivot means comprises:

a) a pivot rod having first and second ends with said first end secured to said rail stop and said second end extending away from said rail stop;

b) a rail bracket adjustably mounted to said brace bracket; and c) means for rotationally coupling said pivot rod second end to said rail bracket.

4. A rail stop assembly according to claim 1, wherein said activating means comprises:

a) lever means for applying a torsional force to said rotational hammer stopping means, thereby causing rotation of said rotational hammer stopping means;

b) actuating means for directing operation of said lever means; and c) linkage means for coupling said actuating means to said lever means.

5. A rail stop assembly according to claim 4, wherein said actuating means is hand operated.

6. A rail stop assembly according to claim 4, wherein said actuating means is hand operated lever secured to an exterior surface of the piano.

7. A rail stop assembly according to claim 4, wherein said linkage means comprises a cable secured to and between said lever means and said actuating means.

8. For use with a piano having key activated hammers, each hammer striking a selected string upon activation by the associated key, a rail stop assembly, comprising:

a) rotational hammer stopping means for preventing a plurality of the hammers from striking the selected strings, wherein said rotational hammer stopping means comprises:
a rail stop;
a brace bracket for securing the assembly to an interior wall of the piano; and
pivot means for connecting in a rotational joining said rail stop to said rail bracket and b) activating means for moving said rotational hammer stopping means between a first position for blocking the hammers and a second position for allowing the hammers to strike the selected strings.

9. A rail stop assembly according to claim 8, wherein said rail stop comprises:

a) an elongated rail having a lower surface and b) a shock absorbing pad for cushioning the impact of the hammer affixed to said rail lower surface.

10. A rail stop assembly according to claim 8, wherein said pivot means comprises:

a) a pivot rod having first and second ends with said first end secured to said rail stop and said second end extending away from said rail stop;

b) a rail bracket adjustably mounted to said brace bracket; and c) means for rotationally coupling said pivot rod second end to said rail bracket.

11. A rail stop assembly according to claim 8, wherein said activating means comprises:

a) lever means for applying a torsional force to said rotational hammer stopping means, thereby causing rotation of said rotational hammer stopping means;

b) actuating means for directing operation of said lever means; and c) linkage means for coupling said actuating means to said lever means.

12. A rail stop assembly according to claim 11, wherein said actuating means is hand operated.

13. A rail stop assembly according to claim 11, wherein said actuating means is hand operated lever secured to an exterior surface of the piano.

14. A rail stop assembly according to claim 11, wherein said linkage means comprises a cable secured to and between said lever means and said actuating means.

15. For use with a piano having key activated hammers, each hammer striking a selected string upon activation by the associated key, a rail stop assembly, comprising:

a) rotational hammer stopping means for preventing a plurality of the hammers from striking the selected strings, wherein said rotational hammer stopping means comprises:
1) a rail stop, wherein said rail stop comprises:
A) an elongated rail having a lower surface and
B) a shock absorbing pad for cushioning the impact of the hammer affixed to said rail lower surface;
2) a brace bracket for securing the assembly to an interior wall of the piano; and
3) pivot means for connecting in a rotational joining said rail stop to said rail bracket, wherein said pivot means comprises:
A) a pivot rod having first and second ends with said first end secured to said rail stop and said second end extending away from said rail stop;
B) a rail bracket adjustably mounted to said brace bracket; and C) means for rotationally coupling said pivot rod second end to said rail bracket; and b) activating means for moving said rotational hammer stopping means between a first position for blocking the hammers and a second position for allowing the hammers to strike the selected strings, wherein said activating means comprises:

1) lever means for applying a torsional force to said rotational hammer stopping means, thereby causing rotation of said rotational hammer stopping means;

2) actuating means for directing operation of said lever means; and 3) linkage means for coupling said actuating means to said lever means.

16. A rail stop assembly according to claim 15, wherein said actuating means is hand operated.

17. A rail stop assembly according to claim 15, wherein said actuating means is hand operated lever secured to an exterior surface of the piano.

18. A rail stop assembly according to claim 15, wherein said rotational coupling means includes a vibration absorbing grommet.

19. For use with a piano having key activated hammers, each hammer striking a selected string upon activation by the associated key, a rail stop assembly, comprising in combination with sensor adapted piano keys that activate the hammers:

a) rotational hammer stopping means for preventing a plurality of the hammers from striking the selected strings, wherein said rotational hammer stopping means comprises:

1) a rail stop, wherein said rail stop comprises:

A) an elongated rail having a lower surface and

B) a shock absorbing pad for cushioning the impact of the hammer affixed to said rail lower surface;

2) a brace bracket for securing the assembly to an interior wall of the piano; and 3) pivot means for connecting in a rotational joining said rail stop to said rail bracket, wherein said pivot means includes a vibration absorbing grommet; and b) activating means for moving said rotational hammer stopping means between a first position for blocking the hammers and a second position for allowing the hammers to strike the selected strings.

* * * * *